US006290039B1

(12) United States Patent
Chen

(10) Patent No.: US 6,290,039 B1
(45) Date of Patent: Sep. 18, 2001

(54) PROTECTIVE FENDER FOR LUGGAGE

(76) Inventor: Shou Mao Chen, 344, Sec. 1, Chung Shan Rd., Ta Cha Township, Taichung Hsien (TW)

( * ) Notice: Subject to any disclaimer, the term of this patent is extended or adjusted under 35 U.S.C. 154(b) by 0 days.

(21) Appl. No.: 09/640,508

(22) Filed: Aug. 17, 2000

(51) Int. Cl.[7] ..... A45C 13/26
(52) U.S. Cl. ..... 190/37; 190/126; 190/127
(58) Field of Search ..... 190/126, 127, 190/37

(56) References Cited

U.S. PATENT DOCUMENTS 2,263,467 * 11/1941 Medoff ..... 190/126
2,487,951 * 11/1949 Stein ..... 190/126
4,383,142 * 5/1983 Kaneko ..... 190/126
4,784,248 * 11/1988 Workman ..... 190/126
4,943,046 * 7/1990 Beltzig ..... 482/35
6,035,982 * 3/2000 Wei-Chih ..... 190/37

* cited by examiner

*Primary Examiner*—Gene Mancene
*Assistant Examiner*—Tri M. Mai
(74) *Attorney, Agent, or Firm*—Harrison & Egbert

(57) ABSTRACT

A protective fender is intended to provide the outer surface of a luggage shell with protection against abrasion or impact. The protective fender has a protection side and a fastening side opposite to the protection side. The protection side is provided with at least one beading or elastic chain, which is partially embedded in the protection side. The protective fender is secured to the outer surface of the luggage shell such that the fastening side of the protective fender is fastened with the outer surface of the luggage shell, and that the beading or elastic chain of the protection side provide the outer surface of the luggage shell with protection against abrasion or impact.

3 Claims, 8 Drawing Sheets

PROTECTIVE FENDER FOR LUGGAGE

BACKGROUND OF THE INVENTION

1. Field of the Invention

The present invention relates generally to a luggage, and more particularly to a protective fender of the luggage.

2. Description of Related Art

The outer surface of the luggage shell is vulnerable to damage and is therefore provided with one or more protective fenders to protect the luggage shell against friction. As shown in FIG. 1, the conventional protective fender is provided with a smooth protective surface which is not durable and is ineffective in providing the luggage shell with protection against damage caused by friction. The corner edge of the luggage shell is most vulnerable to abrasion. The conventional protective fender is incapable of protecting the corner edges of the luggage shell.

BRIEF SUMMARY OF THE INVENTION

The primary objective of the present invention is to provide a fender for protecting the outer surface of a luggage shell. The fender has a protection surface extending along the longitudinal direction of the fender. The protection surface is provided with at least one elastic chain or beading, which is partially embedded in the protection surface. The elastic chain or beading serves to provide the luggage shell with protection against abrasion and impact.

The features and the advantages of the present invention will be more readily understood upon a thoughtful deliberation of the following detailed description of the present invention with reference to the accompanying drawings.

DETAILED DESCRIPTION OF THE INVENTION

Figure 1:
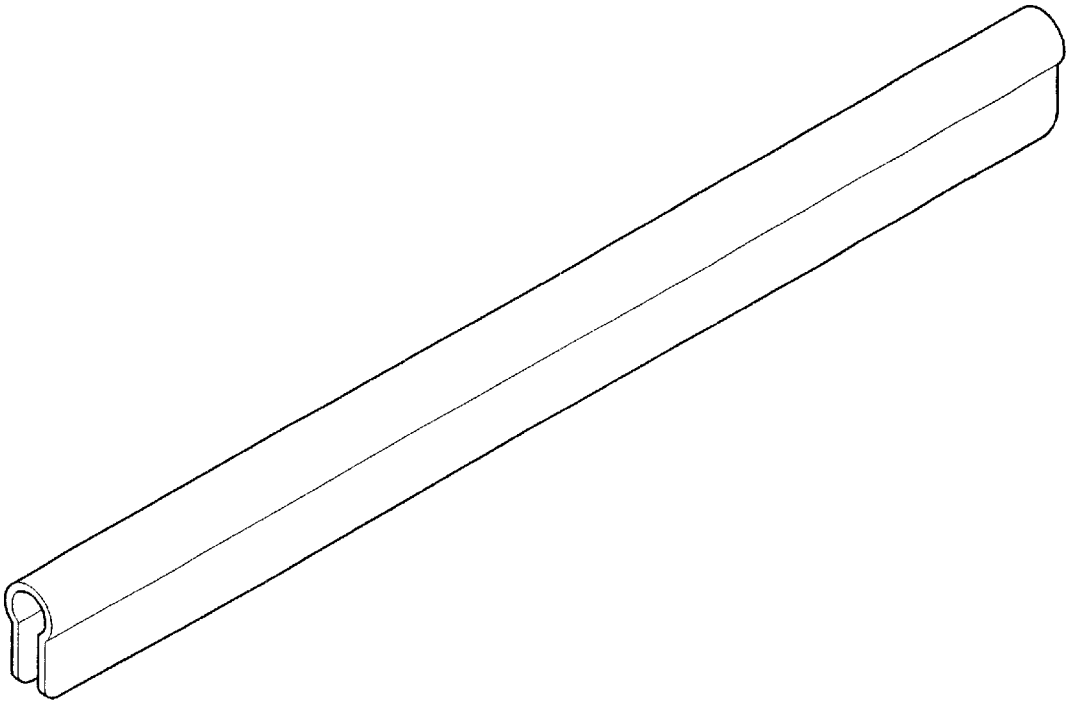
FIG.1 PRIOR ART
FIG. 1 shows a perspective view of a protective fender of the prior art.
Figure 2:
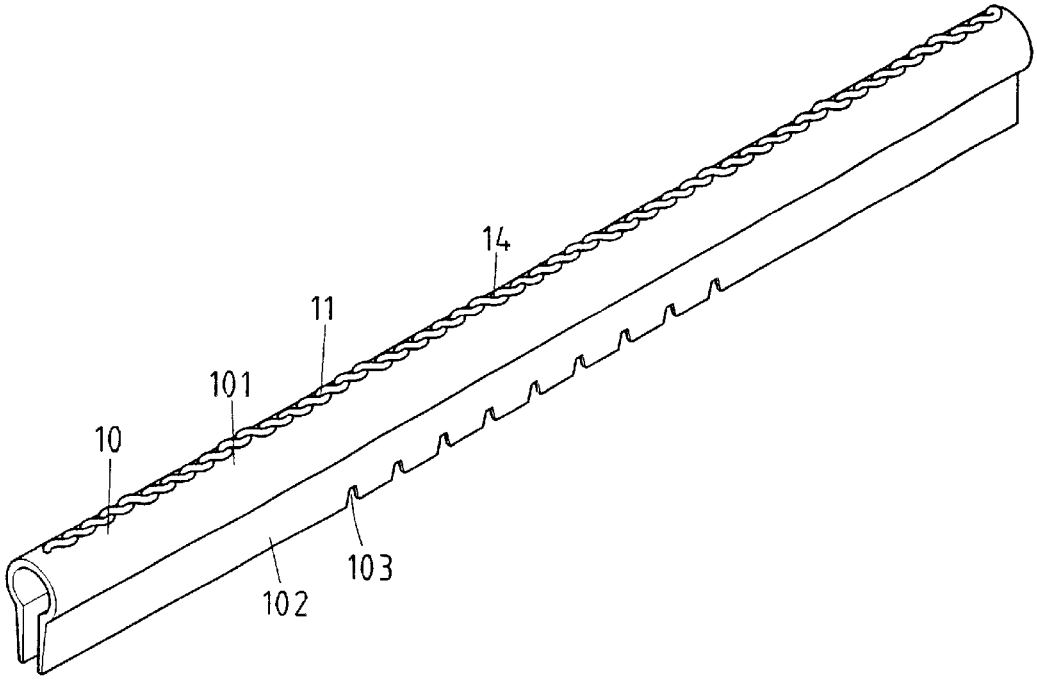
FIG. 2 shows a perspective view of a protective fender of the present invention.
Figure 3:
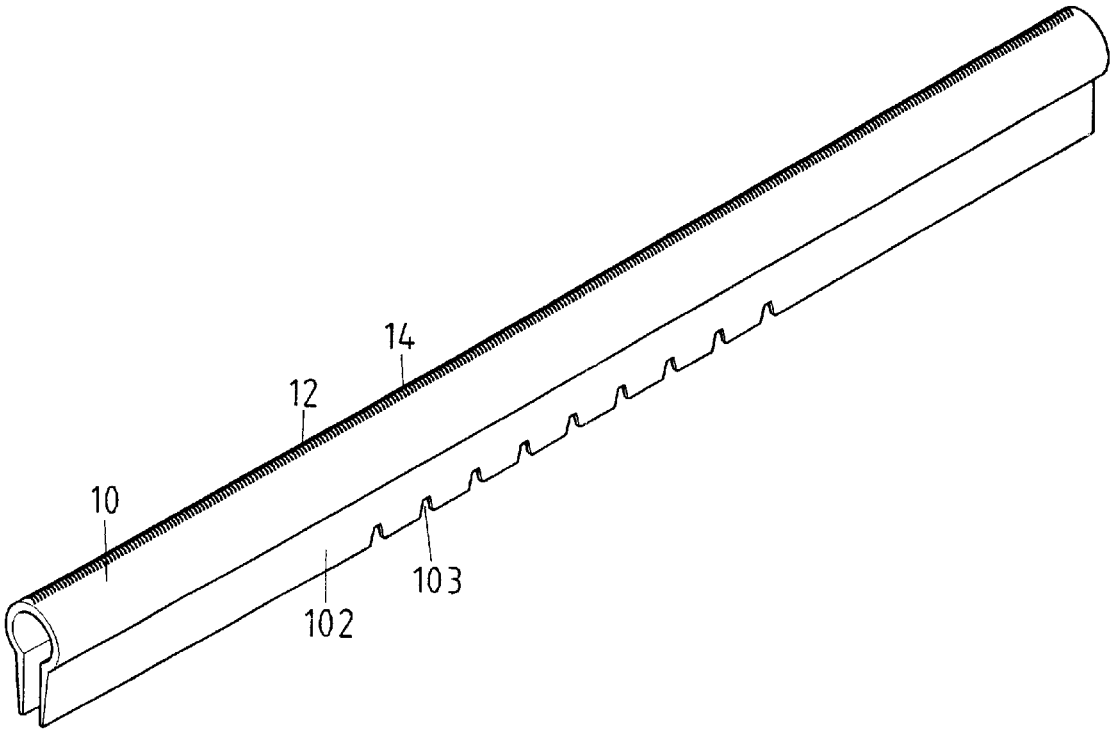
FIG. 3 shows a schematic view of the protective fender of the present invention.
Figure 4:
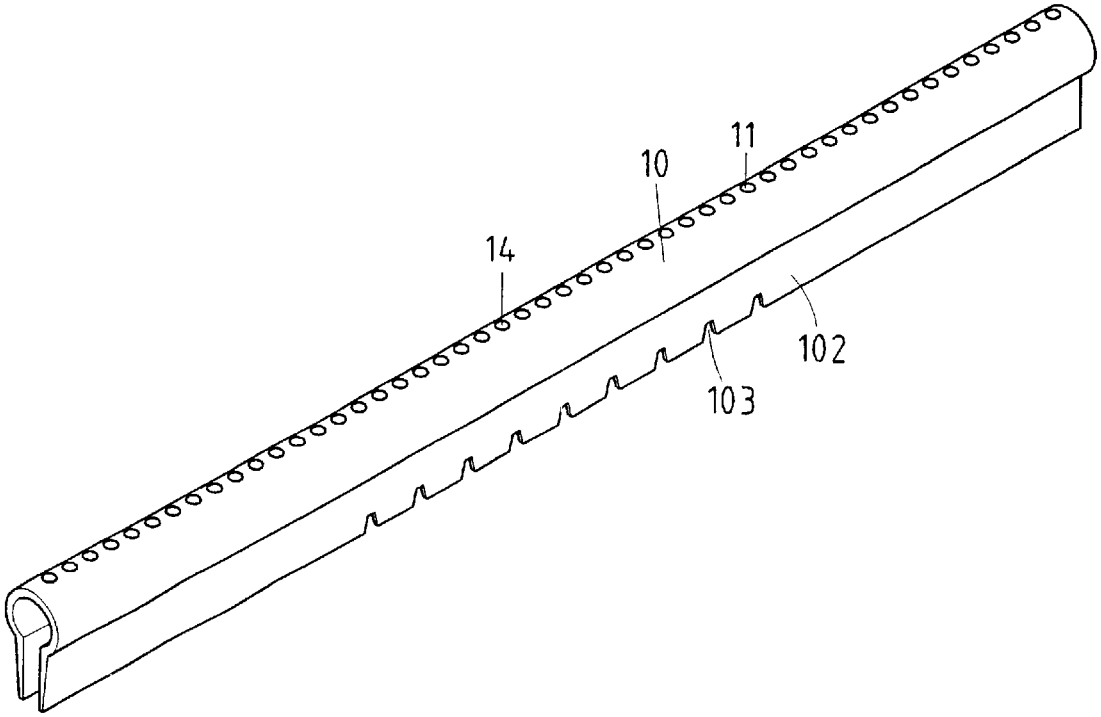
FIG. 4 shows another schematic view of the protective fender of the present invention.
Figure 5:
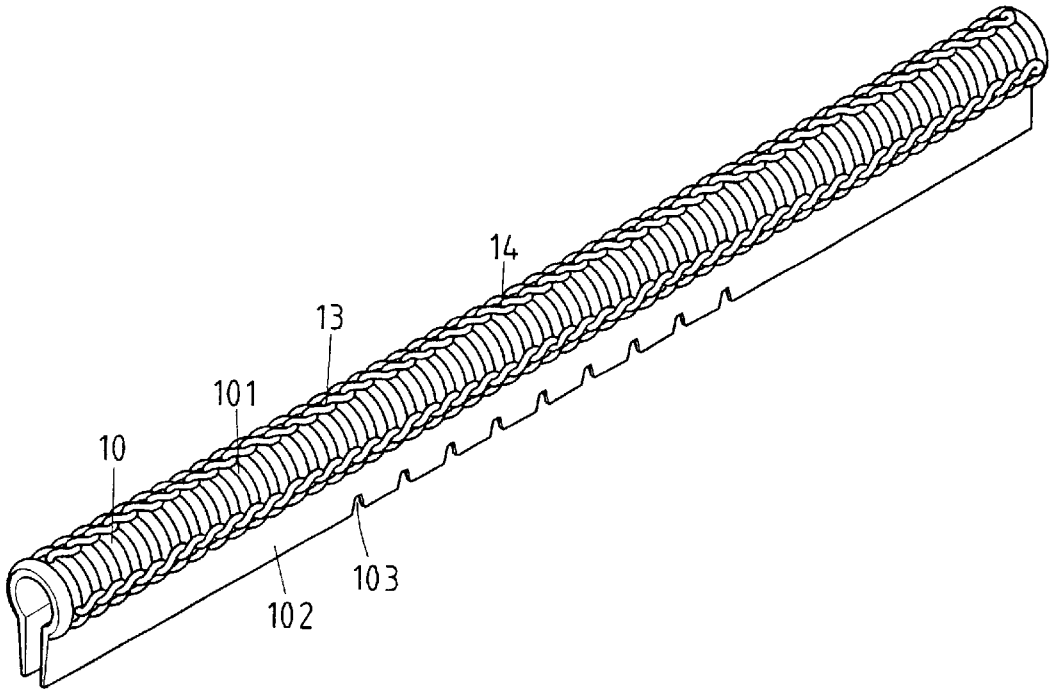
FIG. 5 shows a longitudinal sectional view of the protective fender of the present invention.
Figure 6:
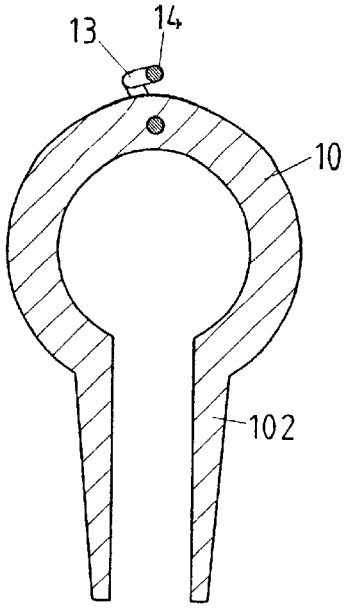
FIG. 6 shows a cross sectional view of the present invention.
Figure 7:
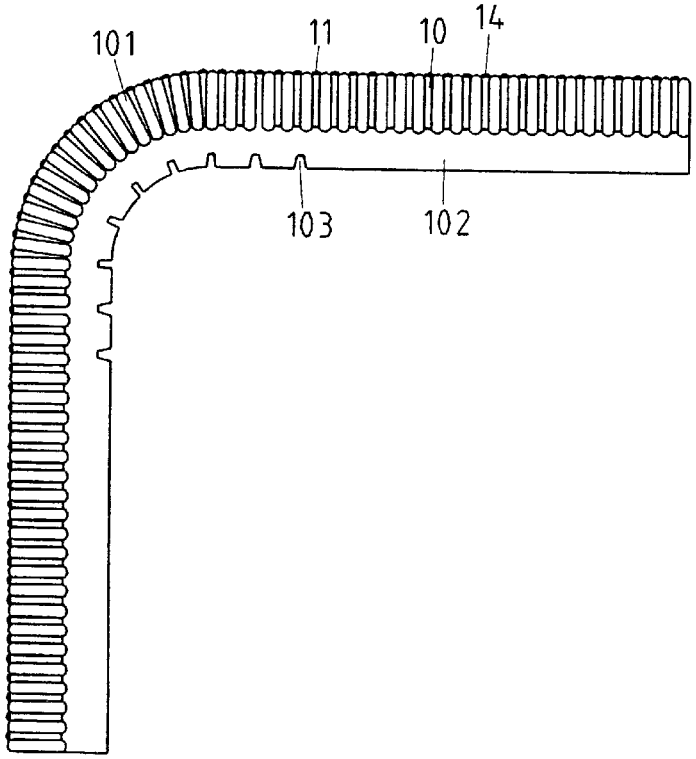
FIG. 7 shows a schematic view of the present invention in use.
Figure 8:
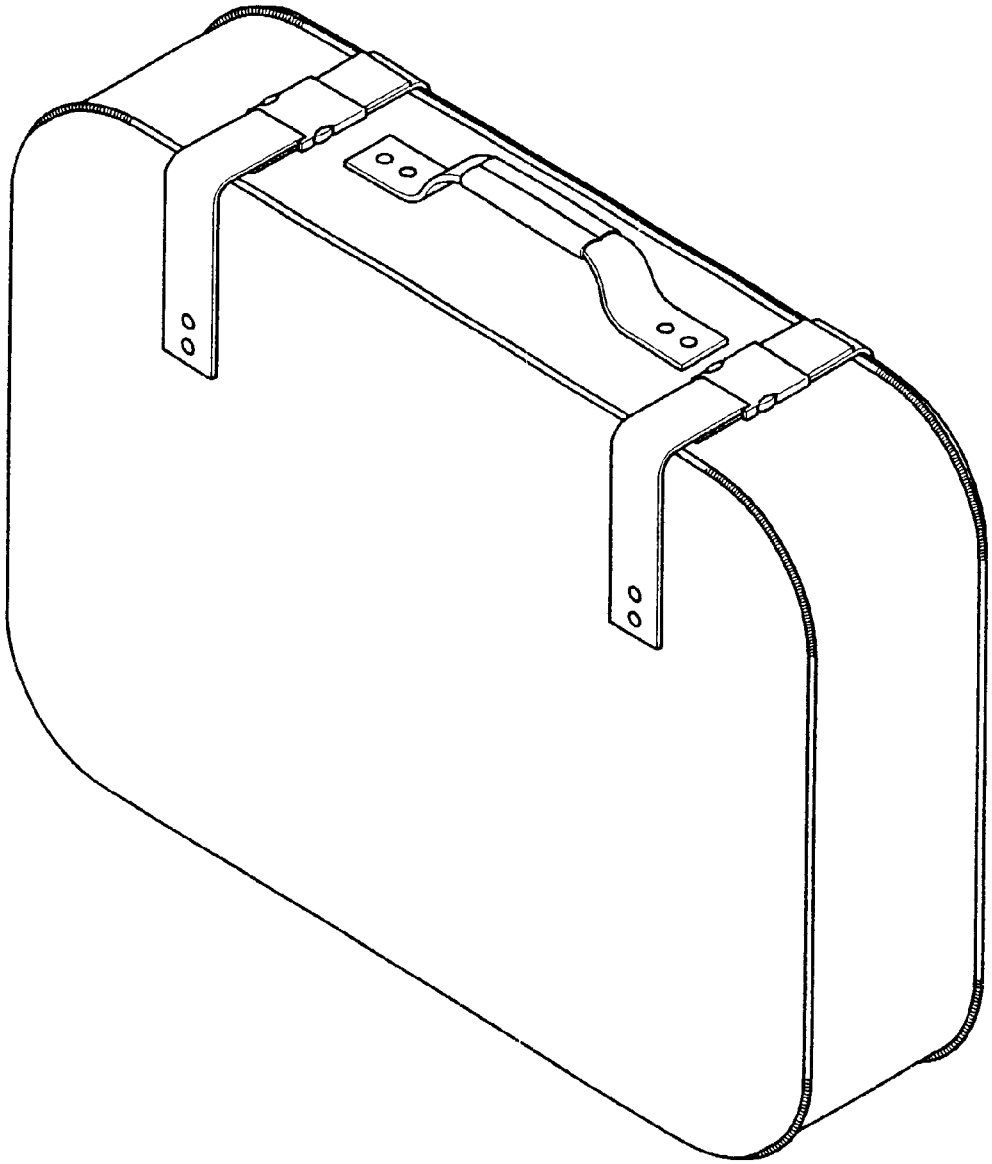
FIG. 8 shows another schematic view of the present invention in use.
Figure 9:
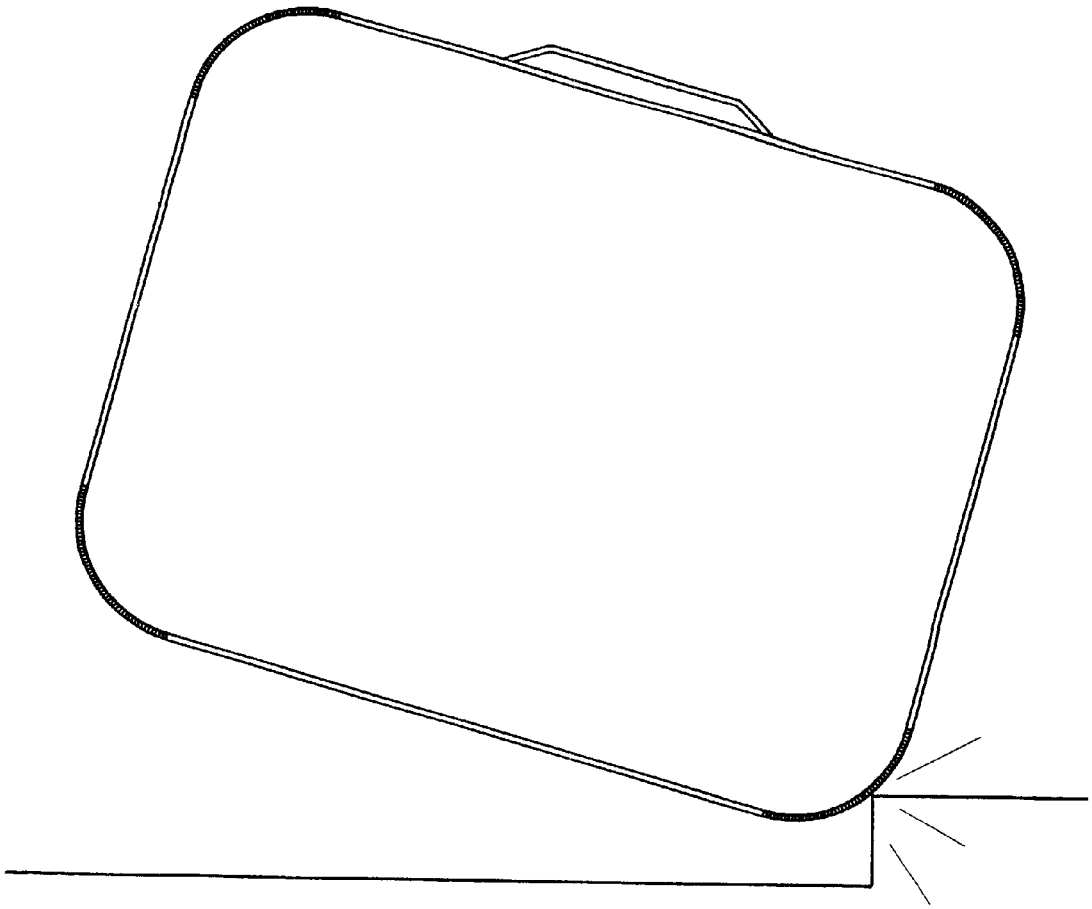
FIG. 9 shows a schematic view of the present invention at work.

As shown in FIGS. 2–8, a protective fender 10 of the present invention is used to provide the outer surface of a luggage shell with protection against abrasion and impact. The protective fender 10 has a protection side 101 extending along the longitudinal direction of the protective fender 10, and a fastening side 102 opposite to the protection side 101. The protection side 101 is provided with at least one spring chain 12 or beading 11, which is partially embedded in the protection side 101. In other words, the spring chain 12 or beading 11 is partially exposed so as to provide the protection side 101 against abrasion and impact. As the protective fender 10 is fastened to the outer surface of a luggage shell by the fastening side 102, as shown in FIGS. 7 and 8, the outer surface or corner of the luggage shell is protected by the spring chain 12 or beading 11 of the protective fender 10 of the present invention.

The fastening side 102 of the protective fender 10 of the present invention is provided with a plurality of notches 103, which are arranged equidistantly and are intended to cancel out the pressure at the time when the protective fender 10 is so curved as to fasten to the curved corners of the luggage shell.

The protective fender 10 of the present invention serves to provide the outer surface of the luggage shell with protection against abrasion and impact, thanks to the beading 11 and the spring chain 12 of the protection side 101 of the protective fender 10.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

I claim:

1. An apparatus comprising:

a luggage article having a shell with an outer surface;

a protective fender having a longitudinal axis and a thickness, said protective fender having a protection side and a fastening side, said protection side having a elastic chain partially embedded therein by partially penetrating the thickness of said protective fender, said protective fender being secured to said outer surface of said shell, said fastening side of said protective fender being fastened to said outer surface of said shell, said elastic chain protecting said outer surface of said shell against abrasion or impact.

2. The apparatus of claim 1, said elastic chain being a spring chain.

3. The apparatus of claim 1, wherein said fastening side has a plurality of notches formed therein, said plurality of notches being equidistantly spaced from adjacent notches of said of notches.

* * * * *